US005582650A

United States Patent [19]

Simons

[11] Patent Number: 5,582,650

[45] Date of Patent: Dec. 10, 1996

[54] PROCESS FOR CLEANING PARTS SOILED OR ENCRUSTED WITH POLYESTER RESIN

[75] Inventor: Edward L. Simons, Ellicott City, Md.

[73] Assignee: International Paper Company, Odenton, Md.

[21] Appl. No.: 372,119

[22] Filed: Jan. 13, 1995

[51] Int. Cl.[6] ..... B08B 3/12; C11D 3/065

[52] U.S. Cl. ..... 134/1; 134/6; 134/22.14; 134/22.19; 134/29; 134/38; 252/540; 510/245; 510/272

[58] Field of Search ..... 134/1, 6, 7, 8, 134/29, 22.12, 22.14, 22.18, 22.19, 22.17, 26, 38; 252/559, 540

[56] References Cited

U.S. PATENT DOCUMENTS

| | | | |
|---|---|---|---|
| 3,762,952 | 10/1973 | Gouin et al. | 134/1 |
| 3,865,628 | 2/1975 | Callahan et al. | 134/22.19 |
| 4,537,705 | 8/1985 | Mahoney et al. | 134/38 X |
| 4,591,391 | 5/1986 | Shimizu et al. | 134/22.19 |
| 4,838,948 | 6/1989 | Bailey | 134/22.14 |
| 5,064,557 | 11/1991 | Fusiak | 134/38 X |
| 5,259,993 | 11/1993 | Short | 252/542 |

FOREIGN PATENT DOCUMENTS 5-140812 6/1993 Japan .

*Primary Examiner*—Jill Warden
*Assistant Examiner*—Saeed Chaudhry
*Attorney, Agent, or Firm*—Browdy and Neimark

[57] ABSTRACT

A process using primarily aqueous-based surfactants for cleaning machinery, tools, containers and the like to remove polyester resin residue. This process involves four stages, each having one or more steps. The first stage is a pre-wash or preliminary cleaning stage which is followed by an ultra-sonic wash stage. The third stage is a rinse stage and the fourth and last stage is for drying the parts cleaned during the previous three stages of the process. Additionally, a fifth evaporation/drying stage is periodically carried out to remove polyester resin residues from the process as solid waste.

13 Claims, 2 Drawing Sheets

PROCESS FOR CLEANING PARTS SOILED OR ENCRUSTED WITH POLYESTER RESIN

FIELD OF THE INVENTION

The invention relates to a process for cleaning machinery, tools and containers exposed to a polyester resin during its manufacture.

BACKGROUND OF THE INVENTION

In the production of decorative sheets and shaped articles made from cured polyester resin as the solid surfacing material, metal parts such as machinery become encrusted with cured and partially cured resin and must be cleaned during regular maintenance. Changing the color of decorative sheets and shaped articles, a common practice for providing consumers with a wide selection of patterns and color choices, further necessitates removing cured/partially cured polyester resin from machinery in order to avoid contaminating a product having a new pattern or color.

Previously, harsh and hazardous organic solvents such as methylene chloride and acetone were used to maintain and clean machinery, tools and other implements used in the production of decorative sheets and shaped articles made of polyester resin. These machinery, tools and parts were primarily cleaned by dipping in the solvent and/or manually wiping with solvent soaked rags to remove the polyester resin residue. The parts cleaning process previously in use was both hazardous and expensive. Even with recovery of the hazardous organic solvent for reuse, a large amount of solvent was still discarded as waste, posing a problem of disposing large quantities of hazardous wastes.

SUMMARY OF THE INVENTION

It is, accordingly, an object of the invention to overcome deficiencies in the prior art, such as noted above.

Another object of the invention is to provide a parts cleaning process using primarily aqueous-based cleaners that are non-hazardous or of low toxicity.

An advantage of the invention is that it can be used with any polyester resin.

Another advantage of the invention is that it provides for reduced generation of waste to be disposed.

The invention relates to a process for cleaning cured and partially cured polyester resins from tools, machinery, containers and the like. The process can be divided into four stages, each having one or more steps, namely (1) a pre-wash stage or preliminary cleaning stage, (2) an ultra-sonic wash stage, (3) a rinse stage constituting the last parts cleaning stage where any remaining polyester resin residue is to be rinsed off along with any residues from the cleaning solutions used, and (4) a drying stage where cleaned parts are dried.

Additionally, the invention includes an evaporation stage and a drying stage where the aqueous solvent system is concentrated into a sludge or a solid in order to reduce the waste generated from the cleaning process of the invention, and thus reducing the volume of waste needed to be disposed of periodically from the process.

BRIEF DESCRIPTION OF THE DRAWINGS

The above and other objects and the nature and advantages of the present invention will become more apparent from the following detailed description of the invention, taken in conjunction with the drawing, wherein.

DETAILED DESCRIPTION OF THE INVENTION

Figure 1:
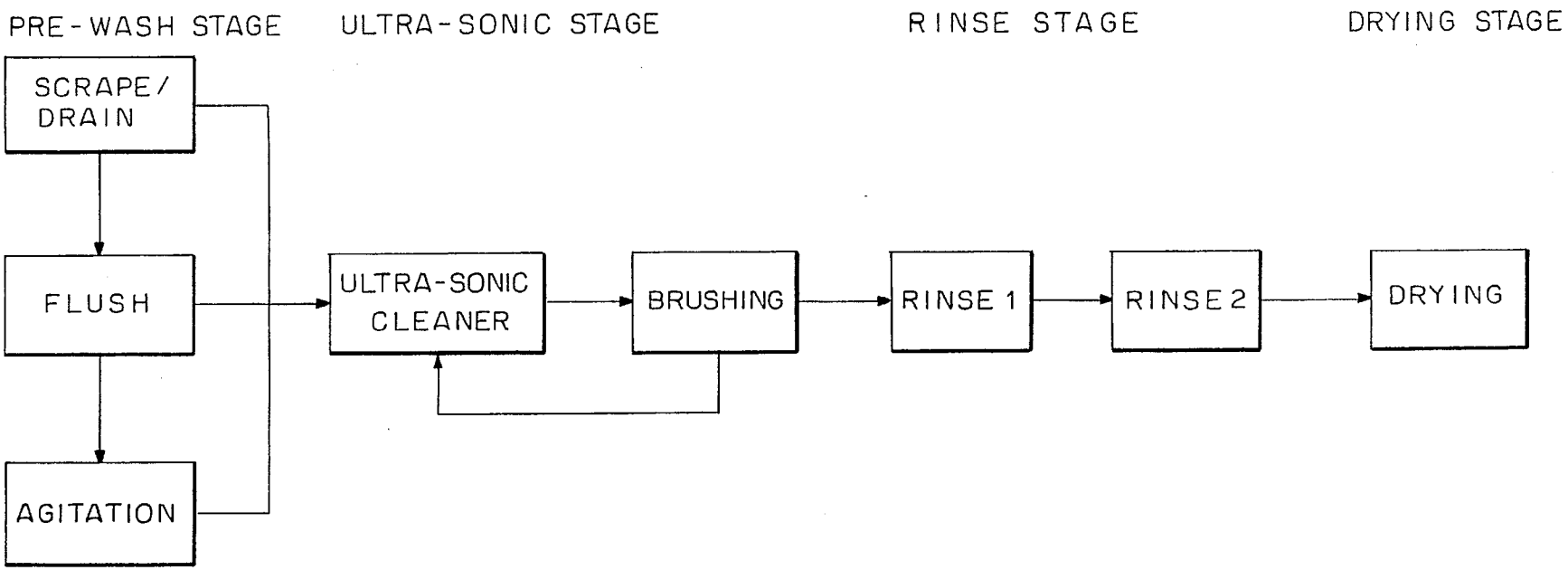
FIG. 1 is a process flow diagram of the parts cleaning process according to the invention.

The process for cleaning cured and partially cured polyester resins from tools, machinery, containers and the like (hereinafter referred to as "part(s)") used in the manufacture of decorative sheets and shaped articles is shown in FIG. 1 as a process flow diagram. The flow diagram divides the cleaning process into the four stages of pre-wash, ultra-sonic cleaning, rinse, and drying with each stage having one or more steps.

In the first pre-wash stage, the parts that have become encrusted with cured and partially cured polyester resin in the manufacture of decorative sheets and shaped articles made from polyester resins or have become encrusted in clean-up during or after manufacture can be "pre-washed", or in other words can be given a preliminary cleaning before moving on to the ultrasonic cleaning stage. This preliminary cleaning normally involves at least a first step of scraping off or draining out of cured or partially cured polyester resin residue from the parts being cleaned.

The scraping off or draining out step is preferably performed manually, and normally removes the majority of polyester resin residue from the part. For instance, a polyester resin residue can be scraped out from a pipe part into a container, such as a five-gallon bucket, using any suitable scraper, preferably a scraper custom-fabricated to a desired shape. Some parts, however, may require a further step of flushing, pre-cleaning by agitation or a combination thereof. The container used for receiving the scraped off polyester resin residue, for example, can itself be scraped and then subjected to the agitation step in the pre-cleaning stage. Another part may be subjected to all three pre-cleaning steps, beginning with scraping and then flushing followed by agitation.

The flushing step of the pre-wash stage is carried out by attaching the part(s) to be cleaned to fittings on a flushing device constructed of a manifold arrangement of piping, valves, and fittings connected to a double-diaphragm pump and a tank, and pumping a solvent wash through the part(s) to be cleaned to flush out polyester resin residue. Normally, an aqueous alkaline surfactant cleaner having a pH in the range of about pH 10–13, but preferably about pH 11, such as THERMA-CLEAN 095-0040, THERMA-CLEAN 095-0080, THERMA-CLEAN 095-0073 (SMC) (all from Cook Composites and Polymers, Kansas City), REPLACETONE (Qual Tech Enterprises, Inc., San Francisco), and Noraclean EC-100 (The Norac Company, Inc., Azusa, Calif.), but preferably THERMA-CLEAN 095-0080, is used as the solvent wash or flush. One of the above aqueous alkaline surfactant cleaners is also used in the ultra-sonic cleaning stage and in the pre-wash agitation step, if any. As an aqueous solvent system, these aqueous alkaline surfactant cleaners are advantageously non-hazardous or of low toxicity. They also provide an advantage over organic solvents with regard to waste reduction. Notwithstanding the advantages of an aqueous solvent system, sometimes, albeit infrequently, a propylene carbonate solvent, such as ARCONATE 1000 (ARCO Chemical Company, Newtown Square, Pa.) and TIPSOLV II (Prillman Chemical Corporation, Martinsville, Va.), may be suitably used as the solvent wash in the flushing step.

THERMA-CLEAN 095-0080 is the preferred aqueous alkaline surfactant mixture for cleaning parts encrusted with partially cured polyester resin, whereas for parts encrusted with fully cured polyester resin, THERMA-CLEAN 095-0073 (SMC) is the preferred aqueous alkaline surfactant mixture.

THERMA-CLEAN 095-0080 and THERMA-CLEAN 095-0073, both supplied by Cook Composites and Polymers (CCP), Kansas City, Mo., are aqueous alkaline surfactant concentrates normally diluted 1:10 and from 1:10 to 1:20, respectively, with water and used separately as cleaning solutions. The alkaline surfactants present in THERMA-CLEAN 095-0080 as a 15–30% by weight component of the concentrate belong to two major classes of alkaline surfactants, namely alkyl phenyl ethoxylates and linear alkyl benzyl sulfonates. Besides 60–80% water, THERMA-CLEAN 095-0080 aqueous alkaline cleaner concentrate also contains 2–6% sodium metasilicate and 5–10% dipropylene glycol methyl ether.

The THERMA-CLEAN 095-0073 aqueous alkaline cleaner concentrate contains less than 15% by weight of sodium metasilicate, less than 80% by weight of water and less than 20% by weight of alkaline surfactants. The alkaline surfactants include at least 1% of an organophosphoric ester surfactant such as Maphos JP-70 (manufactured by PPG-Mazer), at least 0.1% of a non-ionic surfactant such as an acetylenic alcohol or diol, a polyoxyethylene oxide ether of an alkyl phenol or alkanol, or a mixture thereof, and at least 1% of a water-miscible solvent such as 2-pyrrolidone, tetrahydrofurfuryl alcohol, an ethoxylated compound,, or mixtures thereof. This aqueous alkaline cleaner concentrate is more fully described in U.S. Pat. No. 5,259,993.

In the flushing step, one or more parts can be flushed either separately or concurrently at a temperature in the range from about 65° F. to 150° F. for a duration of between about 5 and 90 minutes. The flushing pump is a double-diaphragm pump, such as Wilden pump models MO.25, M-1, M-2, M-4, M-8 and M-16, which pumps solvent wash from a heated holding tank through parts connected to the pump by a series of piping, valves and fitting arranged in a manifold setup. Fittings for any type of pipe can be used, preferably accommodating ¾"–4" diameter pipes. These fittings may be NPT threaded fittings, cam-lock fittings, sanitary fittings or any other type of adaptors for metal parts. The selection of suitable fittings, valves and piping is well within the knowledge of those skilled in the art. To complete the flushing cycle, the solvent wash being flushed through the fittings is recycled back to the heated holding tank.

For parts requiring the agitation step, they are placed in an agitating parts washer device, such as the Ramco Migi-Kleen models MK30, MK36, MK48 (Ramco, Hillside,N.J.), preferably the Ramco Migi-Kleen model MK-36, depending on the size of the soiled parts, and agitated for between about five minutes and two hours at a temperature in the range from about 100° F. to 160° F. The agitating parts washer device provides a cleaning environment in which the parts to be cleaned are submerged in a cleaning tank filled with a solvent wash heated to the desired operating temperature range and in which the parts on a tray or platform are moved up and down in the tank to vigorously agitate the parts in combination with the turbulent flow supplied by multiple solution injectors. Other suitable parts washers that provide sufficient agitation and turbulence to be effective in cleaning the parts can also be used. The solvent wash of this agitation step is one of the aqueous alkaline surfactant cleaners used and described above for the flushing step.

After the pre-wash stage, the parts are transferred to the ultra-sonic wash stage and placed in an ultra-sonic cleaning tank to start a cleaning cycle with a duration of between about 5 and 150 minutes at a temperature in the range of between about 120° to 150° F.

At the start of the ultra-sonic cleaning stage, parts to be cleaned are submerged in an aqueous alkaline surfactant cleaner, described above in the flushing step, either by placing the parts in a basket or by orienting the parts in the ultra-sonic cleaning tank such that the polyester resin residue being emulsified can be sloughed off the parts during ultra-sonic cleaning. Ultra-sonic cleaning can be followed by or can be interrupted two to three times by the brushing off of the emulsified polyester resin residue, depending on the amount of brushing sufficient to remove the emulsified residue. The aqueous alkaline surfactant cleaner used in the ultra-sonic cleaning stage, the flushing step or the agitation step may be the same or different aqueous alkaline surfactant cleaner.

The ultra-sonic cleaning system of the parts cleaning process include a generator, a transducer and a heated cleaning tank filled with an aqueous alkaline surfactant cleaner. Any ultra-sonic cleaning system having a piezo electric or magnetostrictive transducer and a capacity ranging from about 0.25 to 400 gallons and from about 100 to 15,000 Watts are suitable for the invention. For ultra-sonic cleaning systems, Crest models SSMB 175, 4HT-1246-30 (with 4G-2500-3 generator), 4HT-1826-18 (with 4G-1500-18 generator), 4HT-710-3 to 4HT-1246-30 (3 to 86 gallon capacities, 250 to 4500 W) (Crest Ultrasonics, Trenton, N.J.), Blue Wave model WI-1825-1 weld-in transducer, Lewis models L-3625 (80 gallons, 6000 Watts) to L-5450H (350 gallons, 12,000 Watts) (Lewis Corporation, Oxford, Conn.) and Branson models 610, 1012, 1216, 1620 and 2024 (Branson Ultrasonics Corporation, Danbury, Conn.) are preferred, but Crest models SSMB 175, 4HT-1246-30, 4HT-1826-18 and Blue Wave model WI-1825-1 are most preferred.

When a part leaves the ultra-sonic cleaning stage, some residue of solid polyester resin usually still remains on the part as it is transferred, by hoist if necessary, to a first rinse tank where the remaining residue is removed with a brush. Sometimes, only swirling in the rinse tank is needed to remove the remaining emulsified polyester resin residue from the part.

The second step in the rinse stage of the parts cleaning process involves a final rinse with a spray wand in a tank of water to wash off any remaining alkaline surfactant or soap residue from the part. At this point, these clean but wet parts are transferred and placed onto a table in an upside-down orientation to allow water to drain down from and/or out of the part. Compressed air coming from a blow-off nozzle can be used to further remove moisture from the part and speed up the drying step.

With regard to wastes generated in the parts cleaning process, the invention also operates as an evaporation/drying system that discharges only solid wastes for waste disposal purposes. When the level of polyester resin residue or alkaline surfactant residue becomes too high in the rinse tanks, or when the aqueous alkaline surfactant cleaner in either the ultra-sonic cleaning tank, the flushing tank or the agitating parts washer tank becomes contaminated with a high level of emulsified polyester resin residue, the parts cleaning process is switched over to an evaporation/drying system.

Figure 2:
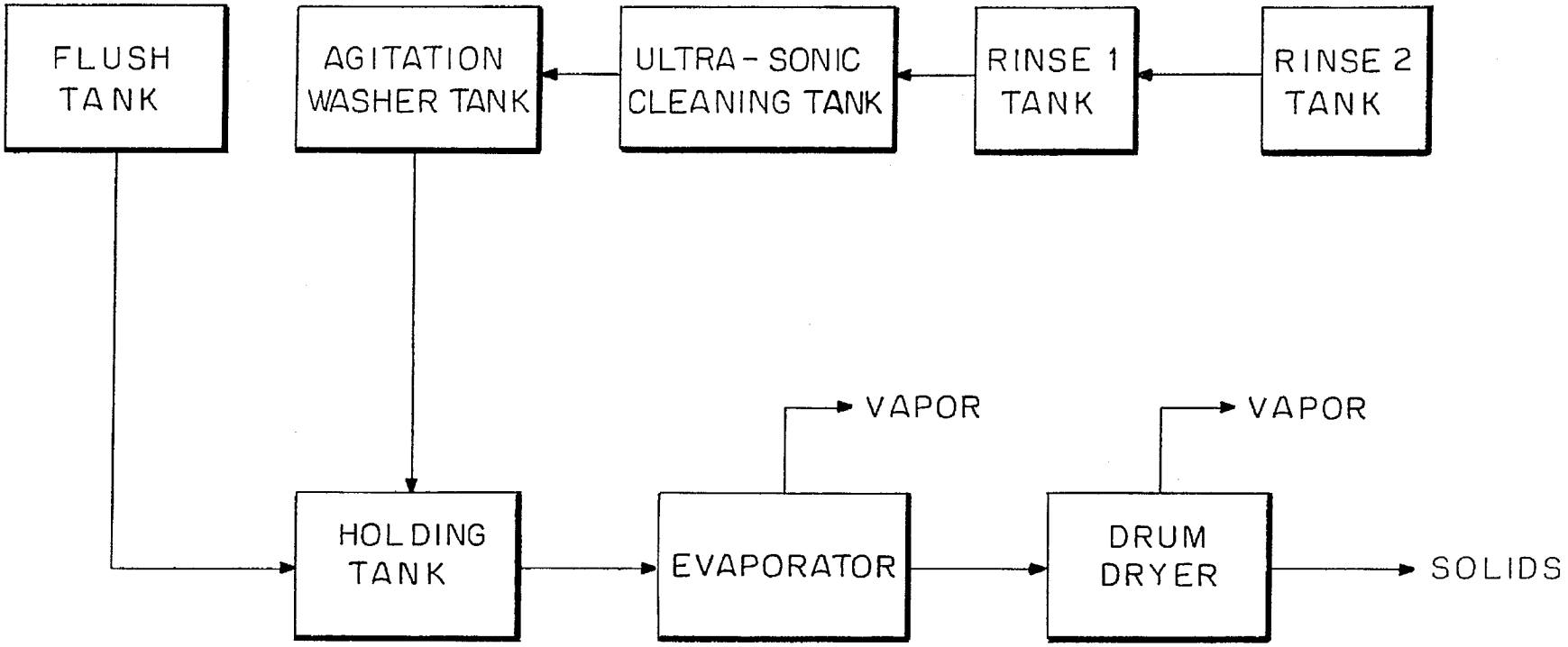
FIG. 2 is a process flow diagram for the waste water cascade and waste solid discharge.

At a frequency of once a day to once a week, the parts cleaning process is interrupted to remove dirty water and contaminated solvent washes from the system as a cascade of water flow (FIG. 2), from the process tanks through the two-step evaporation/drying system for discharge as waste solids. The direction of cascading water flow in FIG. 2 is represented by the arrows. In order to make tank space available for the cascading water flow, the solution in the agitation parts washer and/or the flushing tank is normally pumped out into the holding tank first. The water from the last rinse tank then starts the cascading water flow process from the last rinse tank through the first rinse tank to the ultra-sonic cleaning tank, then to the agitation parts washer tank and/or the flushing tank, and finally into the holding tank. Clean water may further be used to wash the tanks, following the same cascading water flow shown in FIG. 2 and described above.

The water in the holding tank, contaminated with emulsified polyester resin residue and alkaline surfactant soap residue, can be pumped into an evaporator with electric or steam heating coils to yield a liquid concentrate and water vapor. The water vapor is discharged as an exhaust gas and the liquid concentrate is pumped into a drum dryer where water is further evaporated with steam or electric heat to dry the liquid concentrate into a solid slurry or tar-like coating on the drum surface. A knife or blade held angled against the drum surface removes the solid coating from the drum surface as the drum rotates, and discharges the slurry from the system as solid waste. As a result of concentrating emulsified polyester resin/alkaline surfactant residue into a solid slurry, the amount of waste discharged is kept to a minimum.

Preferably, a M. E. Baker model LES-30 (30 gph) evaporator (M. E. Baker Co., Cambridge, Mass.) and a double drum dryer from the Drum Dryer and Flaker Corporation, South Bend, Ind. are used for the evaporation/drying system. However, any other suitable evaporator or drum dryer may also be used in this system. The suitability and sizing of the evaporator and drum dryer are within the knowledge and skill of the art.

Tanks used in the invention are preferably made of 304 or 316 stainless steel, polyethylene, fiberglass reinforced plastic, polypropylene or glass-filled polypropylene. Any of the tanks can be heated with electrical resistance, steam, radiant or other type of heating element. With regard to pumps and valves/piping/fittings, Wilden model MO.25, M-1, M-2, M-4, M-8 and M-16 double-diaphragm pumps are the preferred tank transfer and flushing pumps and valves/piping/fittings are preferably made of 304 or 316 stainless steel, PVC or CPVC.

EXAMPLE 1

Using the equipment described above and a 5–10% aqueous solution of THERMA-CLEAN 095-0080 (THERMA-CLEAN 095-0080 aqueous alkaline cleaner concentrate diluted 1:15 in water) as the cleaning solution, machinery parts and cleaning buckets encrusted with partially cured polyester resin are cleaned with no visible residue remaining, according to the present invention. A typical stainless steel part comes clean with a characteristic shine.

EXAMPLE 2

Using the equipment described above and a 10% aqueous solution of THERMA-CLEAN 095-0073 (SMC) (concentrated THERMA-CLEAN 095-0073 aqueous alkaline cleaner concentrate diluted 1:10 in water) as the cleaning solution, machinery parts and cleaning buckets encrusted with cured polyester resin were cleaned with no visible residue remaining, according to the present invention.

COMPARATIVE EXAMPLE 1

Spray under immersion systems, high pressure washers such as MART Power Washers (The MART Corporation, Maryland Heights, Mo.), high pressure steam washers such as the HELIOJET 1500 (Helios Research Corp., Mumford, N.Y.) and Graymills Corp. (Chicago, Ill.), Safety Kleen and KLEER-FlO (Kleer-flo Co., Eden Prairie, Minn.) solvent-type parts washers all performed unsatisfactorily with or without the above-mentioned aqueous-based alkaline surfactant cleaner in removing polyester resin residue from soiled parts. Typically, these systems left some residue, whether emulsified or not, on the parts and were unable to clean out the inside and outside of the parts.

COMPARATIVE EXAMPLE 2

Solvent systems based on terpenes, d-limones, and pine and citrus-based chemistries were found to be ineffective in cleaning parts of polyester resin residue. These solvents do not break down or emulsify the polyester resin residue on the parts, regardless of the length of time in the cleaning cycle. Parts are as soiled at the end of cleaning as at the beginning.

COMPARATIVE EXAMPLE 3

N-methyl pyrrolidone and dibasic ester solvent systems were found to be only marginally effective. While these solvent systems did dissolve some polyester material after a 24 hour soaking period, significant amounts of residue were still visible on the parts at the end of the period. These solvent systems have the added disadvantage of being toxic and expensive to use.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A process for cleaning parts soiled or encrusted with partially cured polyester resin, comprising the steps of:

pre-cleaning parts soiled or encrusted with partially cured polyester resin residue by scraping and draining out said polyester resin residue;

washing said parts soiled or encrusted with partially cured polyester resin residue at least once in an ultrasonic cleaning device with an aqueous alkaline surfactant cleaner consisting essentially of an alkyl phenyl ethoxylate and a linear alkyl benzyl sulfonate, to emulsify and dislodge said polyester resin residue from said parts, said parts being submerged in said aqueous alkaline surfactant cleaner, then brushing off said emulsified polyester resin residue, wherein said aqueous alkaline surfactant cleaner has a pH in the range of about 10–13;

rinsing and brushing said parts with water in a rinse tank to remove any remaining emulsified polyester resin residue from said parts;

rinsing said parts again with water using a spray wand in a tank of water to remove any aqueous alkaline surfactant cleaner remaining on said parts;

placing said parts on a table to dry; and subjecting said parts to compressed air to further dry said parts.

2. A process as recited in claim 1, further comprising a step of flushing said parts with said aqueous alkaline surfactant cleaner having a pH in the range of about 10–13 in a flushing device before said washing and brushing step.

3. A process as recited in claim 2, wherein the pH of said aqueous alkaline surfactant cleaner is about 11.

4. A process as recited in claim 1, further comprising a step of agitating said parts in a parts washer device with said aqueous alkaline surfactant cleaner having a pH in the range of about 10–13 before said washing and brushing step.

5. A process as recited in claim 4, wherein the pH of said aqueous alkaline surfactant cleaner is about 11.

6. A process as recited in claim 1, further comprising the steps of:

evaporating water from said rinsing steps and from said aqueous alkaline surfactant cleaner contaminated with said emulsified polyester resin residue in an evaporator; and drying said polyester resin residue emulsified with said alkaline surfactant cleaner in a drum dryer for later disposal as waste.

7. A process as recited in claim 1, wherein the pH of said aqueous alkaline surfactant cleaner is about 11.

8. A process as recited in claim 1, further comprising a step of flushing said parts with a propylene carbonate solvent in a flushing device before said washing and brushing step.

9. A process for cleaning parts soiled or encrusted with partially cured polyester resin, comprising the steps of:

pre-cleaning parts soiled or encrusted with partially cured polyester resin residue by scraping and draining out said polyester resin residue;

washing said parts soiled or encrusted with partially cured polyester resin residue at least once in an ultrasonic cleaning device with an aqueous alkaline surfactant cleaner consisting essentially of an alkyl phenyl ethoxylate, a linear alkyl benzyl sulfonate, sodium metasilicate, and dipropylene glycol methyl ether, to emulsify and dislodge said polyester resin residue from said parts, said parts being submerged in said aqueous alkaline surfactant cleaner, then brushing off said emulsified polyester resin residue, wherein said aqueous alkaline surfactant cleaner has a pH in the range of about 10–13;

rinsing and brushing said parts with water in a rinse tank to remove any remaining emulsified polyester resin residue from said parts;

rinsing said parts again with water using a spray wand in a tank of water to remove any aqueous alkaline surfactant cleaner remaining on said parts;

placing said parts on a table to dry; and subjecting said parts to compressed air to further dry said parts.

10. A process as recited in claim 9, further comprising a step of flushing said parts with said aqueous alkaline surfactant cleaner having a pH of about 11 in a flushing device before said washing and brushing step.

11. A process as recited in claim 9, further comprising a step of agitating said parts washer device with said aqueous alkaline surfactant cleaner having a pH of about 11 before said washing and brushing step.

12. A process as recited in claim 9, further comprising the steps of:

evaporating water from said rinsing steps and from said aqueous alkaline surfactant cleaner contaminated with said emulsified polyester resin residue in an evaporator; and drying said polyester resin residue emulsified with said aqueous alkaline surfactant cleaner in a dryer for later disposal as waste.

13. A process as recited in claim 9, further comprising a step of flushing said parts with a propylene carbonate solvent in a flushing device before said washing and brushing step.

* * * * *